US008112822B2

(12) United States Patent
Yoo

(10) Patent No.: US 8,112,822 B2
(45) Date of Patent: Feb. 14, 2012

(54) TOILET STOOL FOR ODOR REMOVAL WHICH APPLIES THE RESERVING ENERGY AS POWER SOURCE

(76) Inventor: Kwang Tae Yoo, Seoul (KR)

( * ) Notice: Subject to any disclaimer, the term of this patent is extended or adjusted under 35 U.S.C. 154(b) by 99 days.

(21) Appl. No.: 12/739,734

(22) PCT Filed: Oct. 29, 2008

(86) PCT No.: PCT/KR2008/006377
§ 371 (c)(1),
(2), (4) Date: Apr. 24, 2010

(87) PCT Pub. No.: WO2009/057943
PCT Pub. Date: May 7, 2009

(65) Prior Publication Data

US 2010/0242161 A1 Sep. 30, 2010

(30) Foreign Application Priority Data

Nov. 1, 2007 (KR) ..... 10-2007-0110783

(51) Int. Cl.
*E03D 9/04* (2006.01)

(52) U.S. Cl. ..... 4/213

(58) Field of Classification Search ..... 4/213, 443–448, 4/479, 222, 300, 319, 320
See application file for complete search history.

(56) References Cited

U.S. PATENT DOCUMENTS 5,930,844 A * 8/1999 Scott, III ..... 4/213

FOREIGN PATENT DOCUMENTS

| | | |
|---|---|---|
| KR | 20-0169267 | 11/1999 |
| KR | 10-0499313 | 5/2000 |
| KR | 20-0301084 | 1/2003 |
| KR | 10-0461780 | 3/2003 |
| KR | 10-0602603 | 12/2005 |
| KR | 10-0752932 | 8/2007 |

OTHER PUBLICATIONS

International Search Report for PCT/KR2008/006377 mailed Jun. 17, 2009.
Written Opinion of the International Searching Authority for PCT/KR2008/006377 mailed Jun. 17, 2009.
International Preliminary Report on Patentability for PCT/KR20081006377 issued May 4, 2010.

* cited by examiner

*Primary Examiner* — Lori Baker
(74) *Attorney, Agent, or Firm* — Christopher Paul Mitchell

(57) ABSTRACT

An odor removal toilet stool using a preserving energy as a power source, capable of removing bad smell air and preventing its back flow in which the cleaning water (supplying water) stored in a water storage tank is supplied at two stages such as an initial standby water level and later full water level, wherein during supplying water to the full water level, air transference method using hydrodynamic operation occurred from a high speed injection with a injection nozzle is used without electric energy.

8 Claims, 12 Drawing Sheets

[Fig. 1]
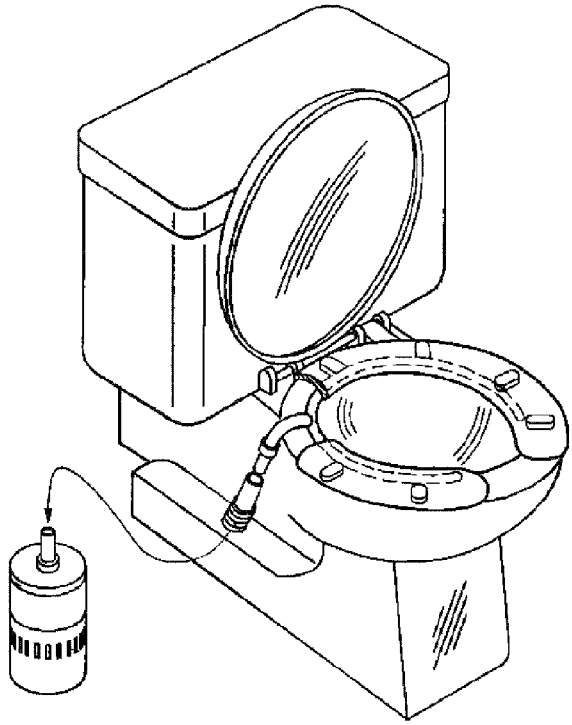
[Fig. 2]
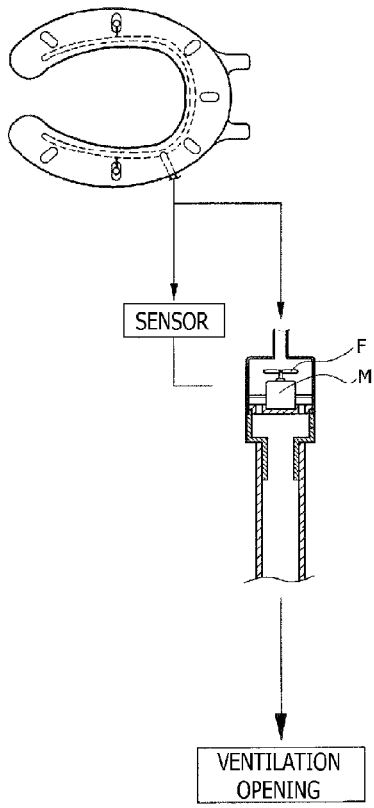

[Fig. 3]
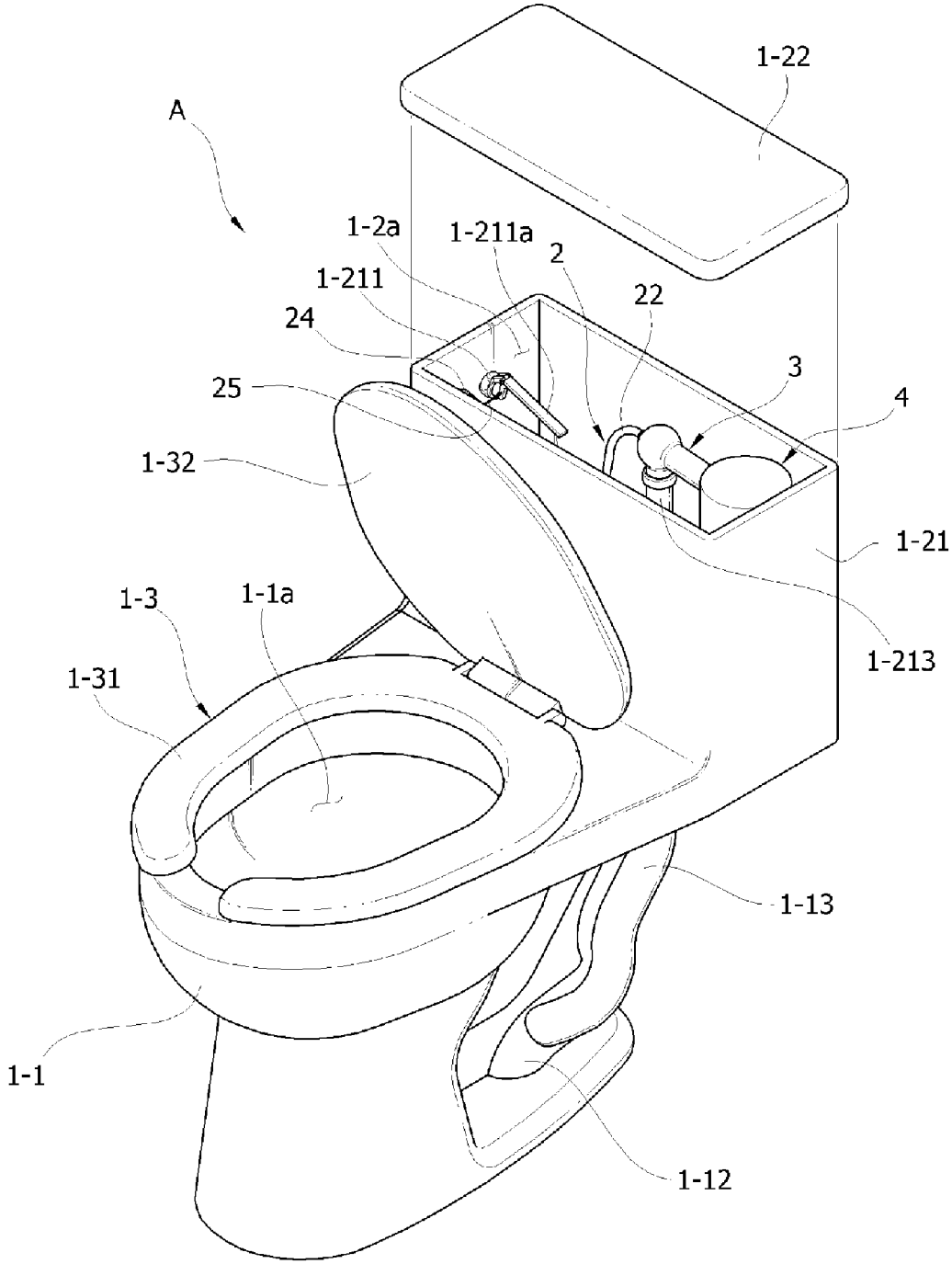

[Fig. 4]
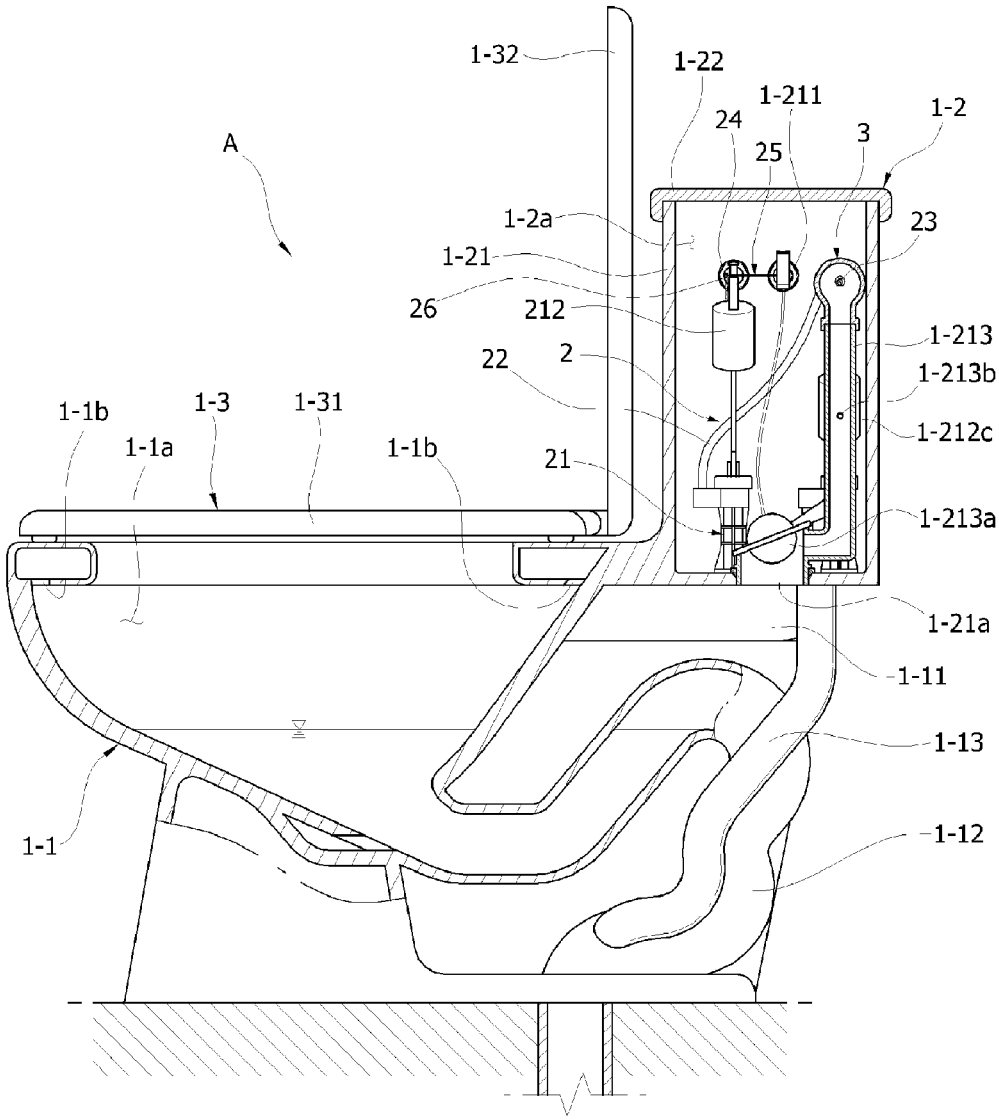

[Fig. 5]
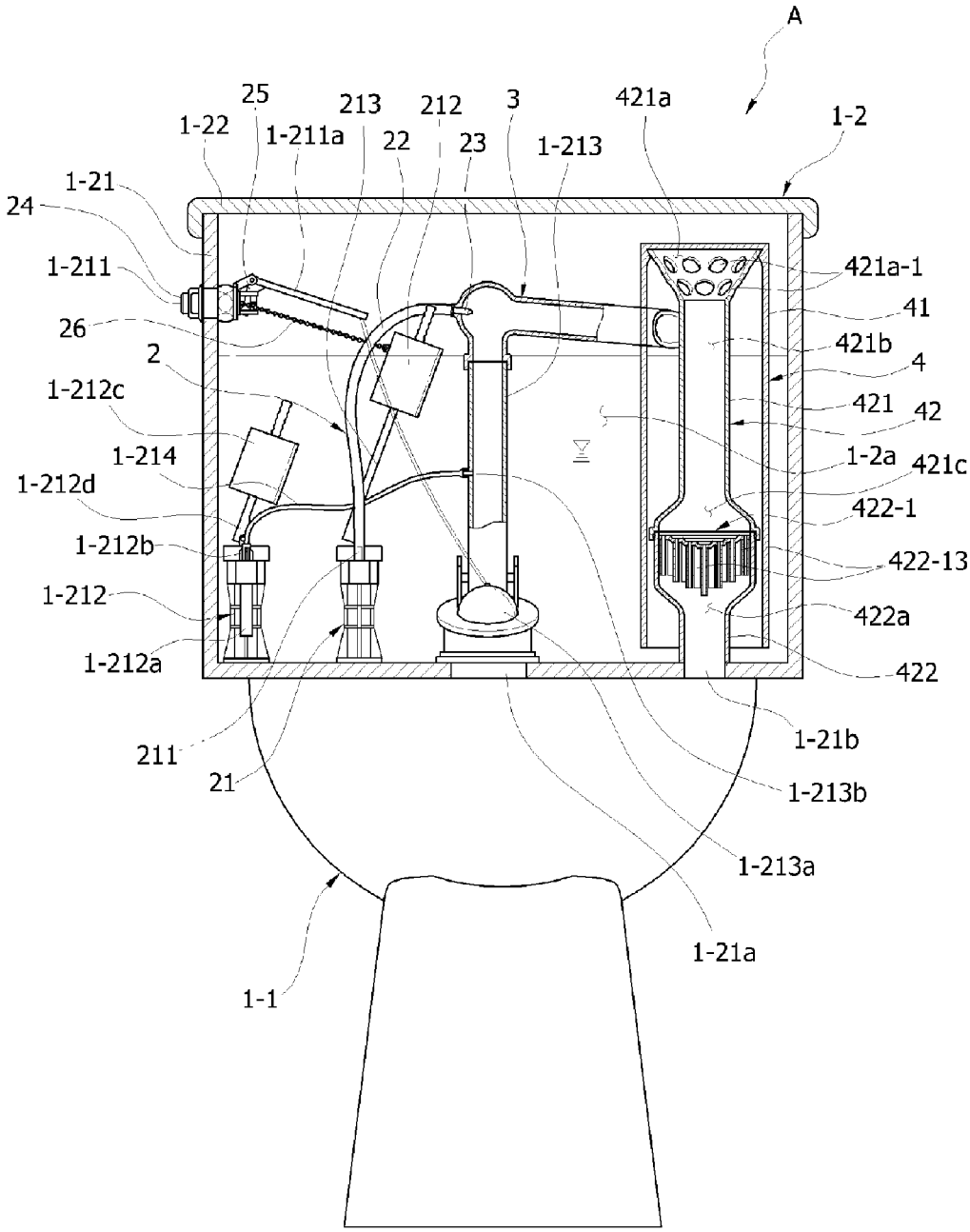

[Fig. 6]
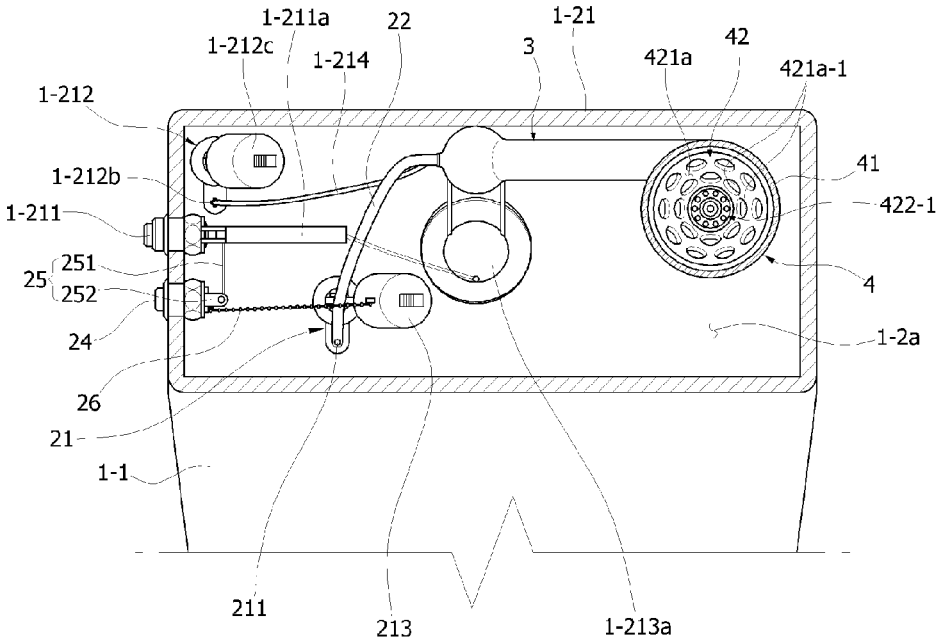
[Fig. 7]
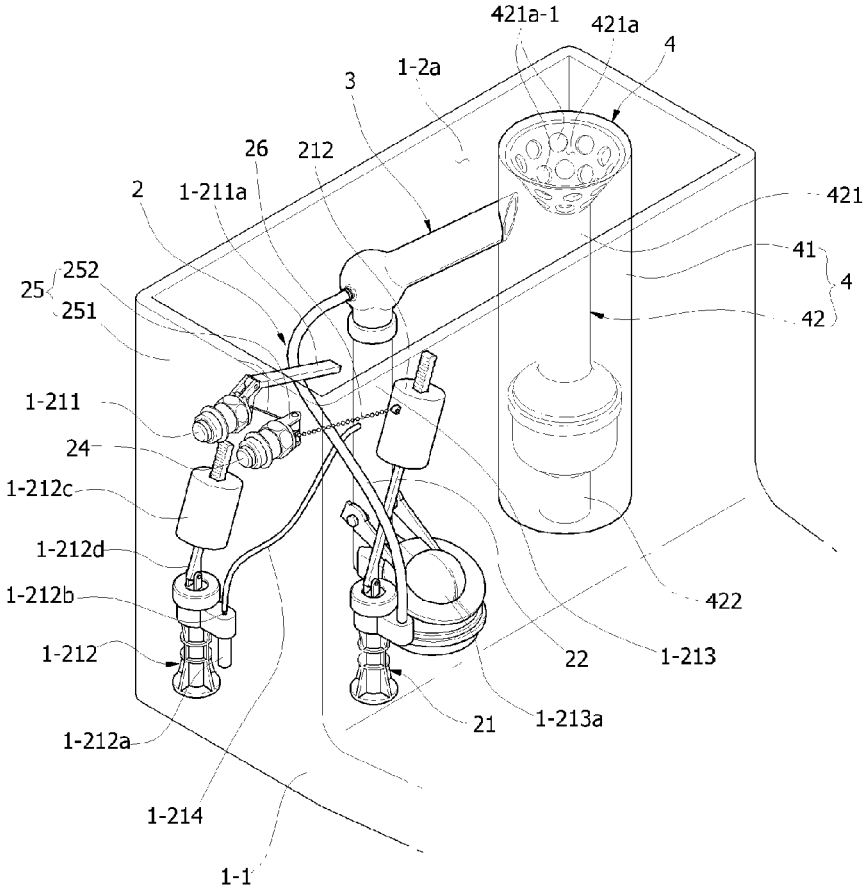

[Fig. 8]
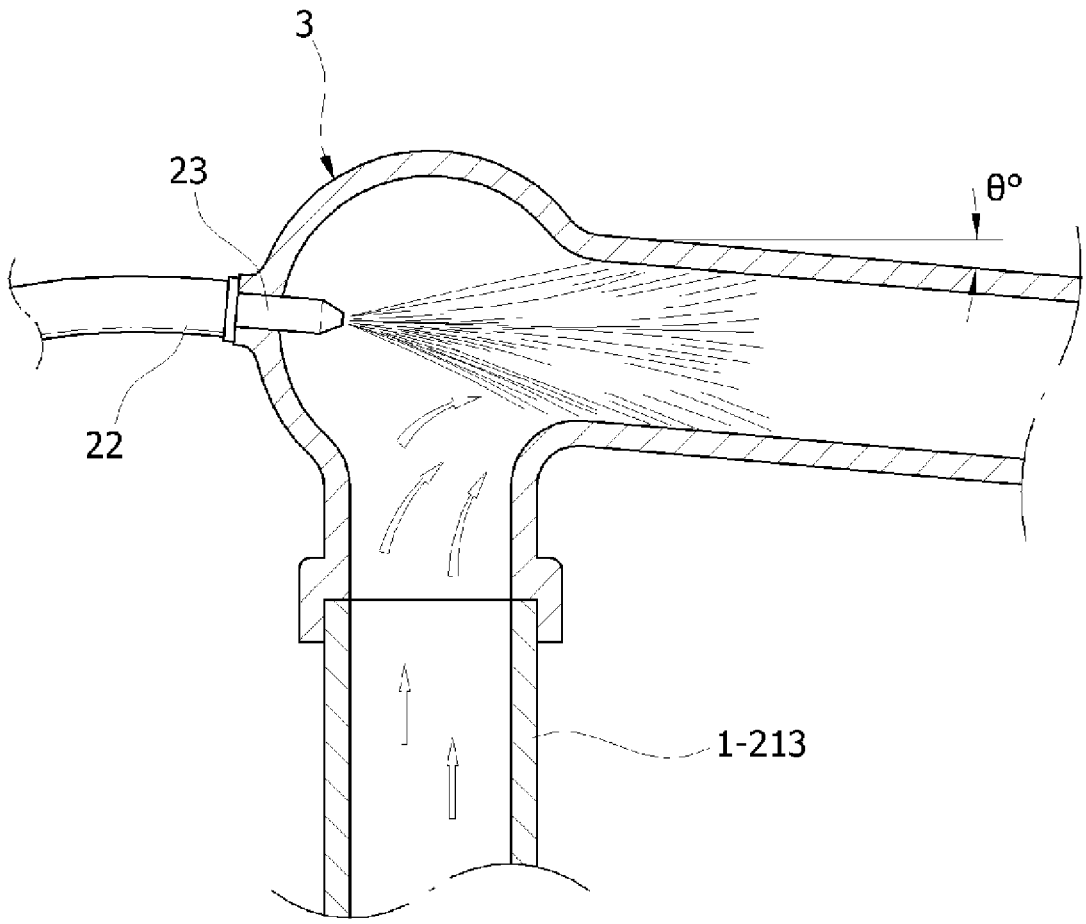

[Fig. 9]
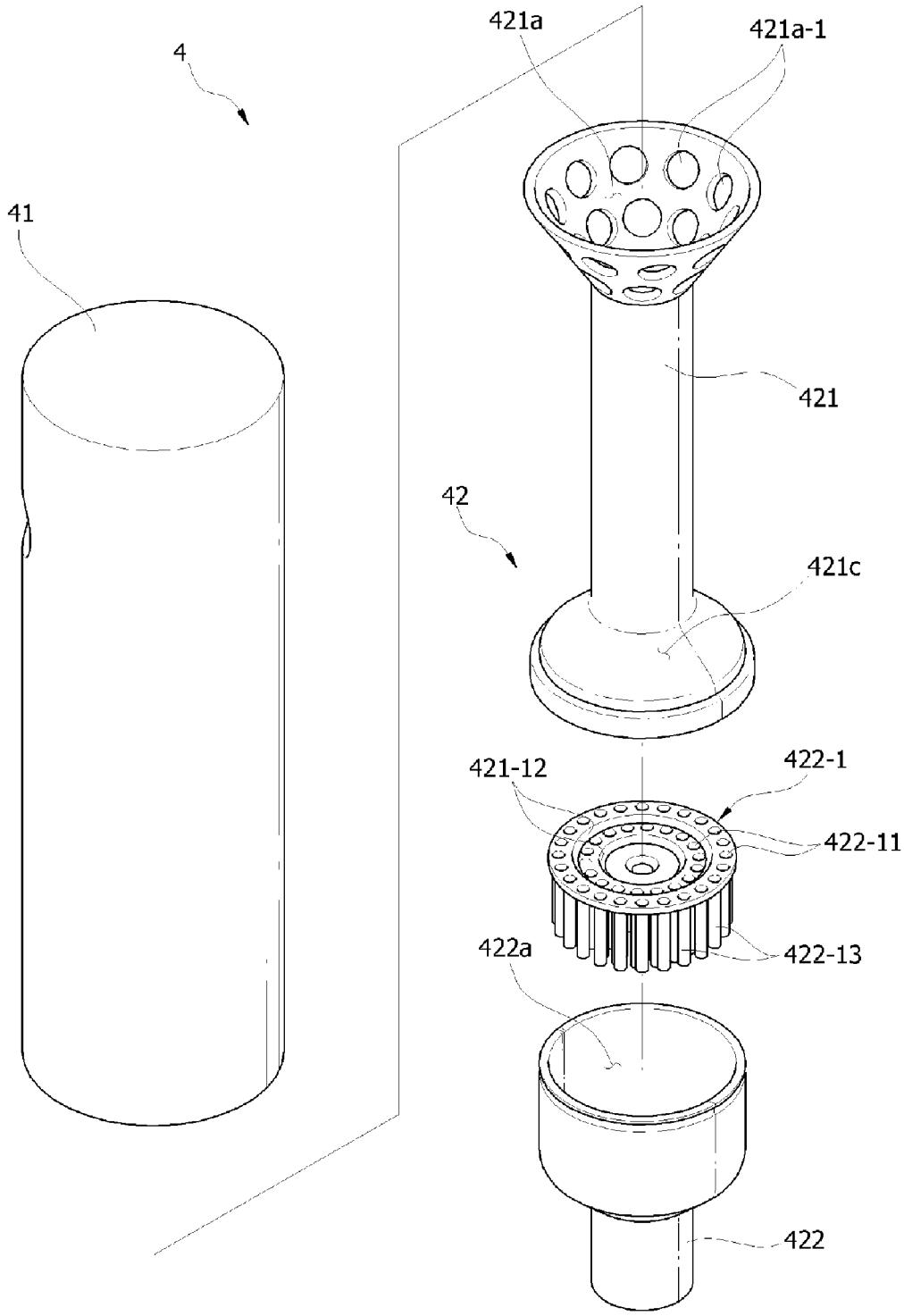

[Fig. 10]
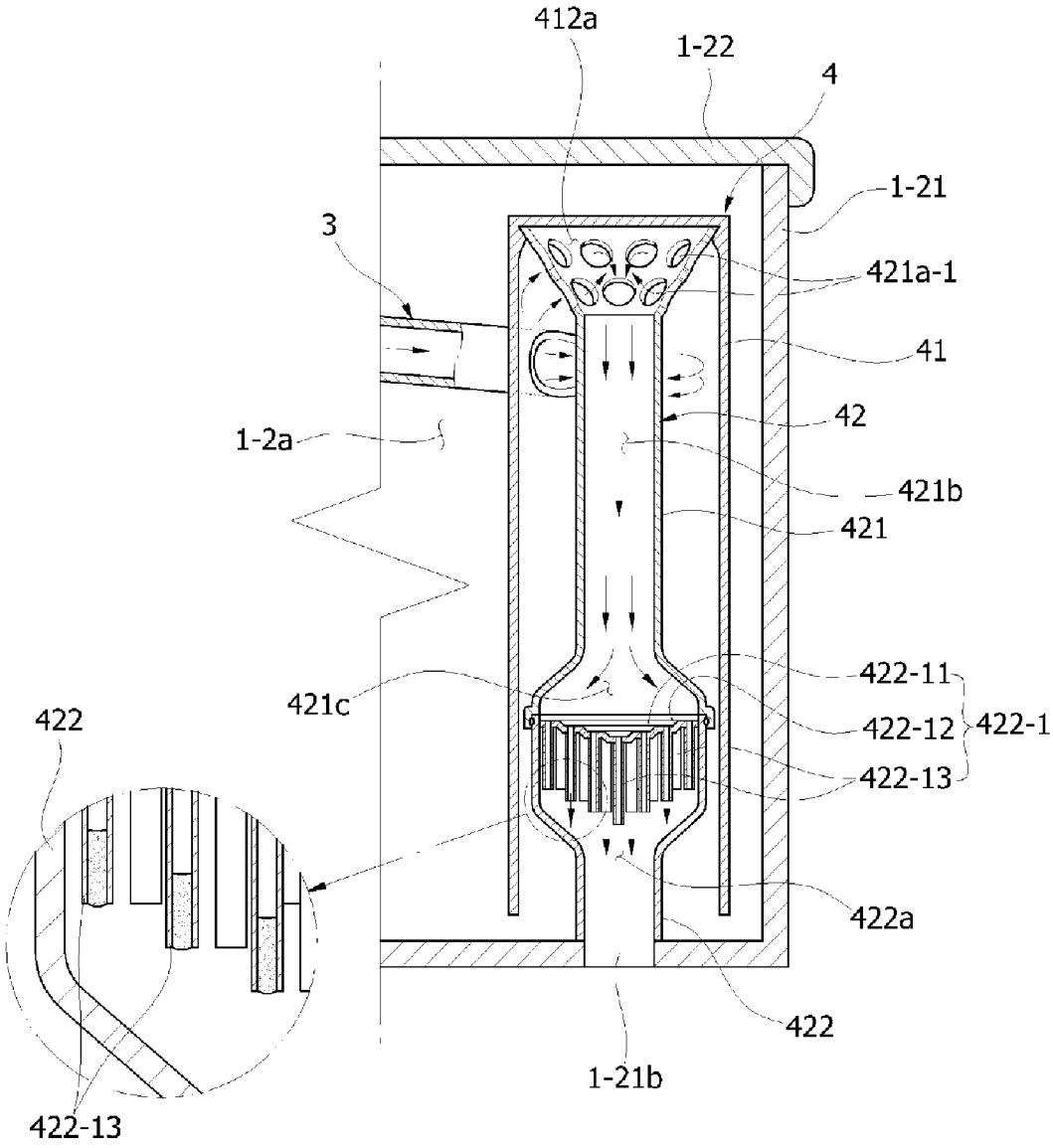

[Fig. 11]
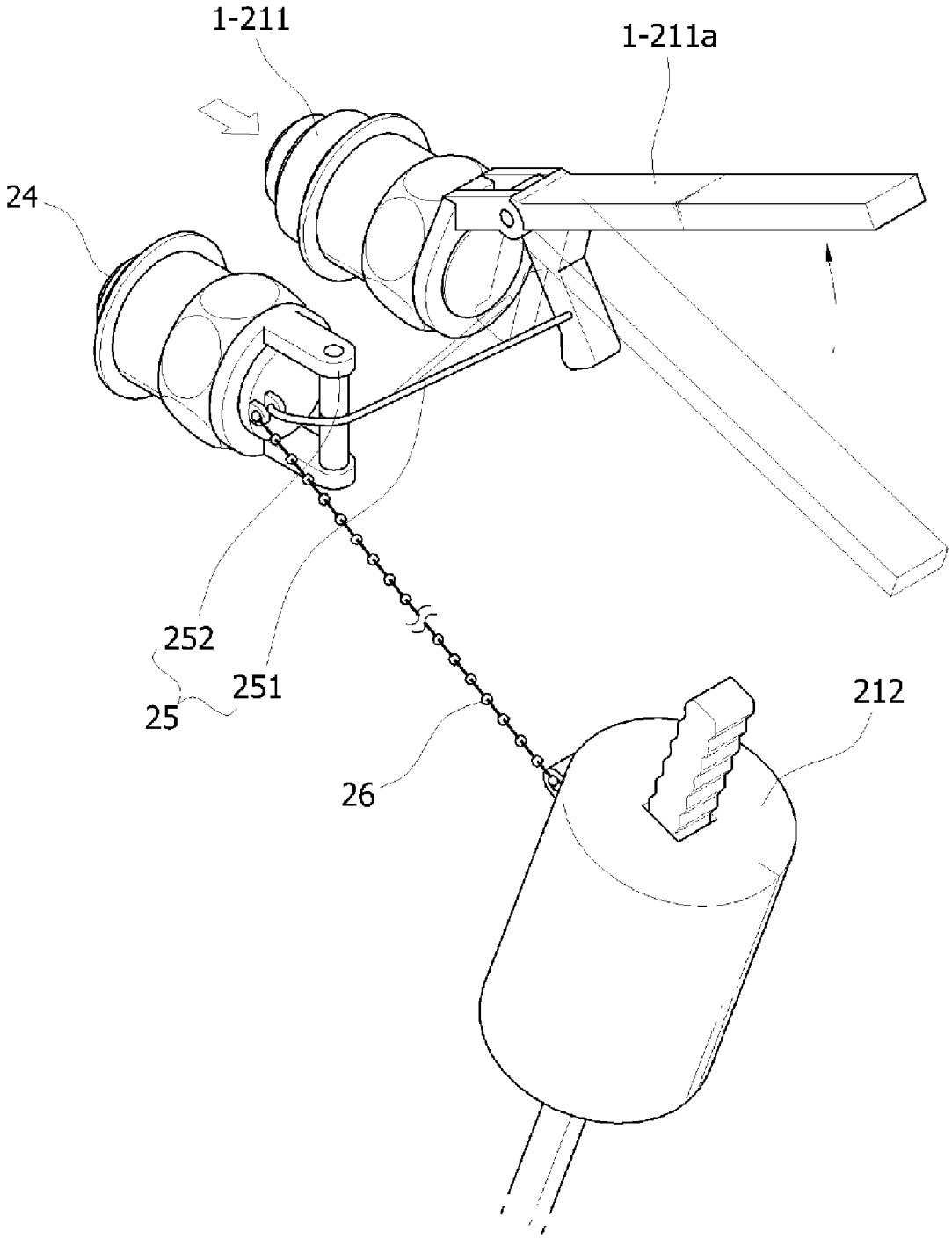

[Fig. 12]
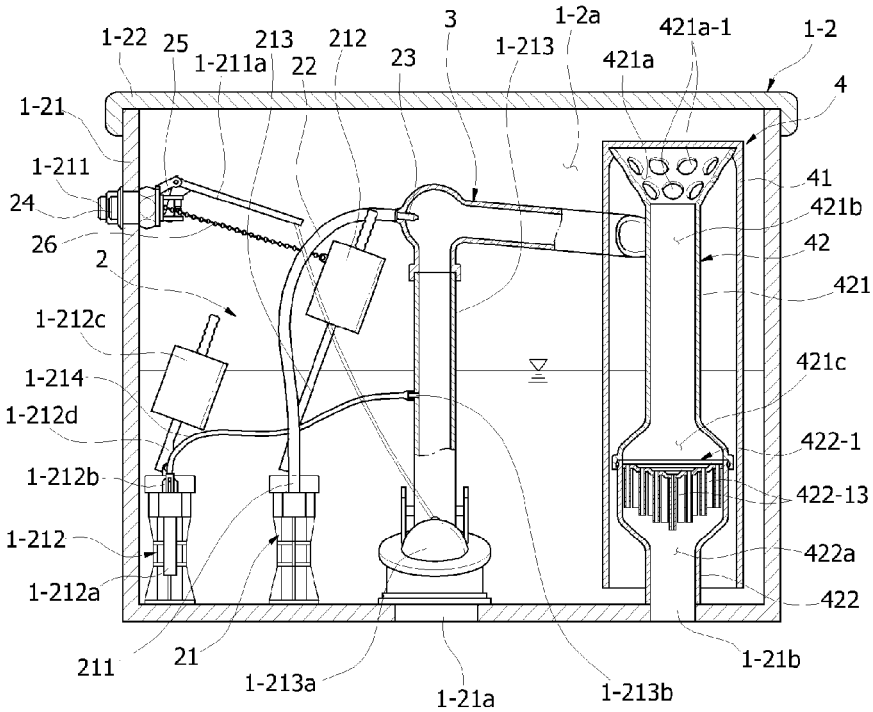
[Fig. 13]
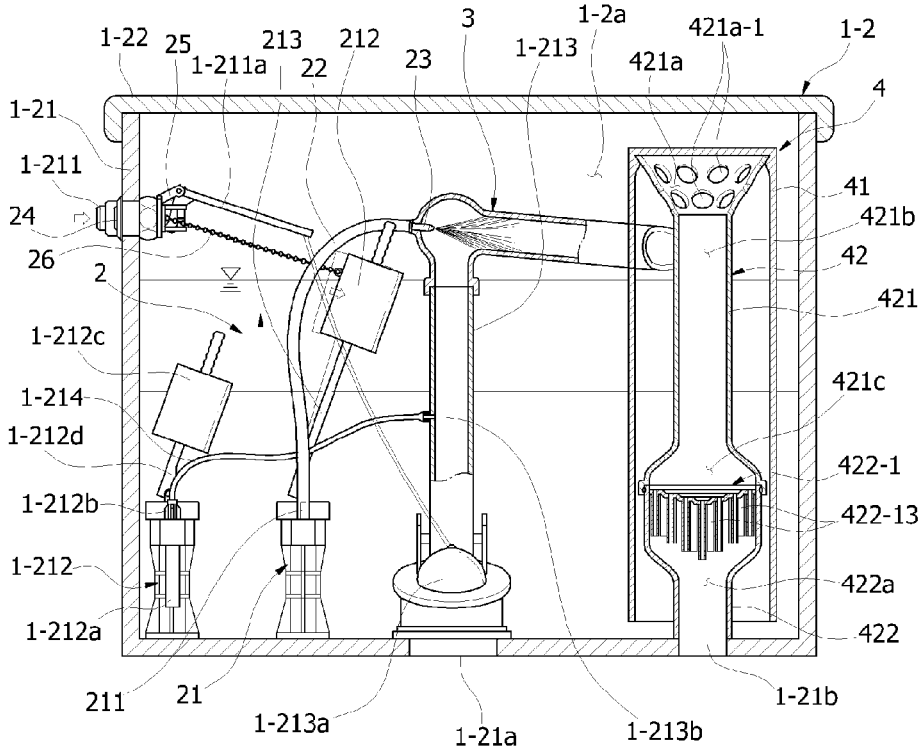

[Fig. 14]
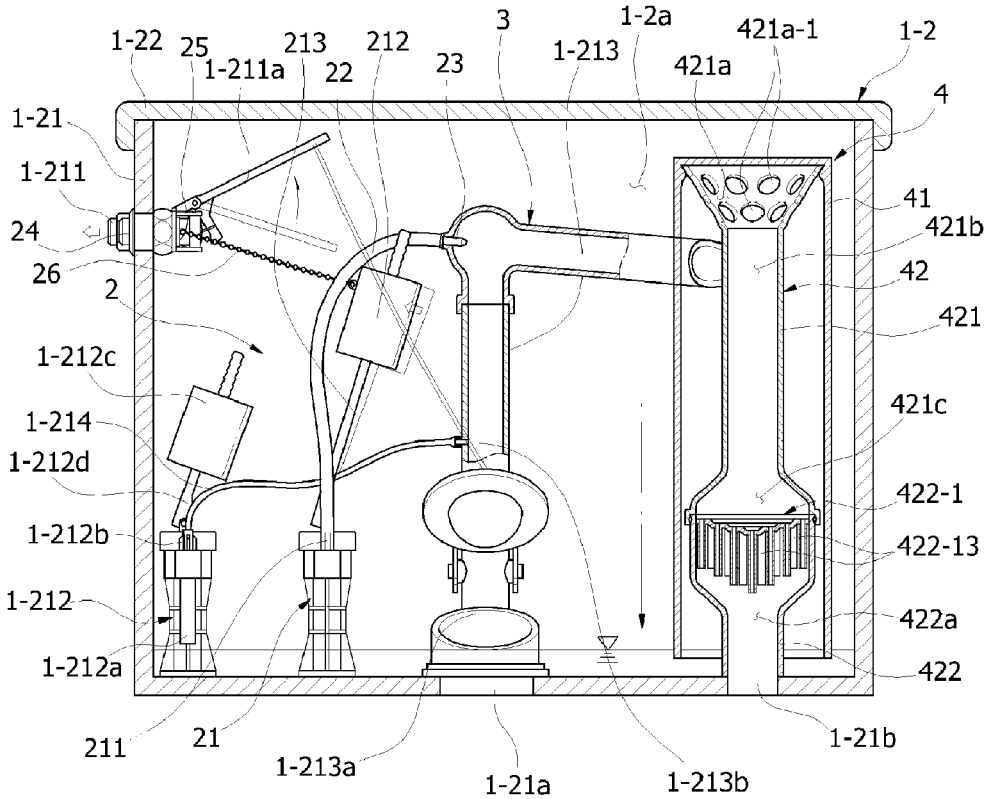
[Fig. 15]
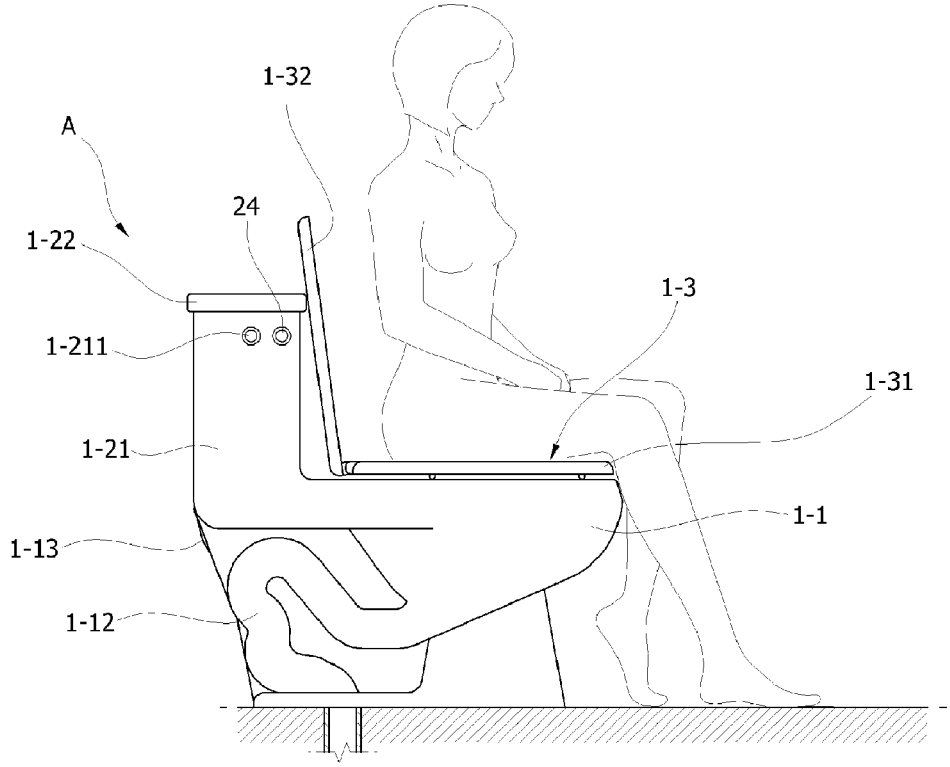

[Fig. 16]
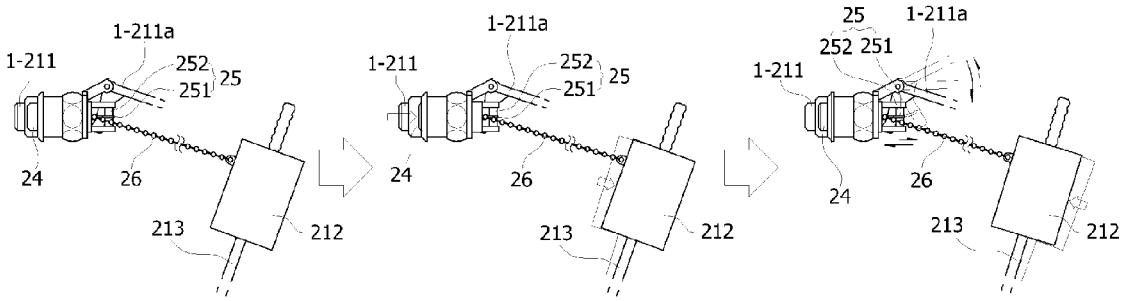
[Fig. 17]
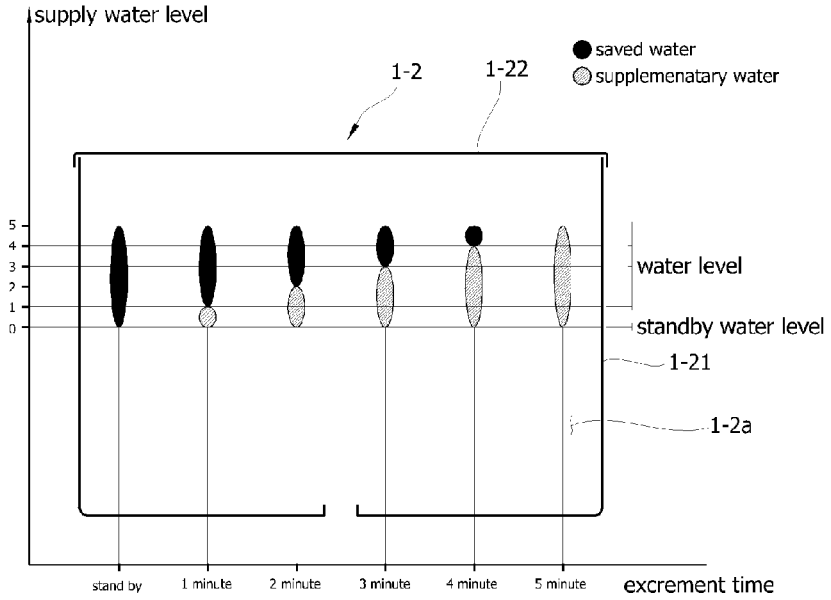

TOILET STOOL FOR ODOR REMOVAL WHICH APPLIES THE RESERVING ENERGY AS POWER SOURCE

RELATED APPLICATIONS

This application is a 371 application of International Application No. PCT/KR2008/006377, filed Oct. 29, 2008, which in turn claims priority from Korean Patent Application No. 10-2007-0110783, filed Nov. 1, 2007, both of which are incorporated herein by reference in their entireties.

TECHNICAL FIELD

The present invention relates to a toilet stool for odor removal, and more particularly, to an improved odor removal toilet stool using a preserving energy as a power source, capable of removing bad smell air and preventing its back flow in which the cleaning water (supplying water) stored in a water storage tank is supplied at two stages such as an initial standby water level and later kill water level, wherein during supplying water to the kill water level, air transference method using hydrodynamic operation occurred from a high speed injection with a injection nozzle is used without electric energy.

BACKGROUND ART

Generally, a toilet stool refers to a western style flush toilet on which a person may astride and excrete wherein when excreting by using the toilet stool, the feces and urine excreted from the eliminatory organ inside body of a user make promptly bad smell air.

In more detail, when a small amount of the excrement such as feces and urine being excreted by the user who sits on a toilet seat drops into a fresh water in a pre-determined space inside a toilet body, and most of bad smell air is made during this extreme instant moment of dropping, which makes the surrounding persons unpleasant.

Currently various types of the western style toilet stools with a odor removal function have been studied, developed and sold in a market to solve overall problems including the aforementioned unpleasant feeling. Among these disclosures, Korean Utility Model registration No. 20-0169267 disclosed a odor removal configuration for a toilet stool in which the bad smell air is absorbed and discharged with an impeller (F) using a rotation force obtained through a suction motor (M) which is driven using external power source. Up until now, this type of technology has been adopted typically for removing bad smell air.

However, according to the prior art, a separate power source such as electric energy for driving the suction motor (M) and impeller (F) has to be necessary and further the mechanical noise produced in operating these devices exceeds to reference values such as 60 dB (night) to 80 dB (daytime), which is noted on "regulation reference of daily life noise and vibration" in Table 8 of enforcement regulation (related to the same act 21(2)) of the noise and vibration regulation act prescribed on the Ministry of Environment decree No. 247 (fully revised on Sep. 13, 2007). Meanwhile, the suction motor making a roaring sound often stimulates user's nerves and makes him/her troubled regardless of the aforementioned regulation reference of daily life noise.

Additionally, taking into consideration of the characteristic configuration of the western style toilet, the inner diameter of a discharging tube for absorbing/discharging bad smell air is much limitative, and further a centrifugal fan manufactured for an absorption, instead of general air ventilation such as a axial flow type fan, is properly adopted, however, there has arisen a problem in that a wide space is needed for installing the suction motor (M) a rotation per minute (rpm) of which becomes higher to perform efficiently the absorption, and the impeller (F) a diameter of which is enlarged to perform efficiently the discharge, causing manufacturing cost expensive and further making the life noise reference greater.

DISCLOSURE OF INVENTION

Technical Problem

One object of the present invention is to solve the aforementioned problems and provide an odor removal toilet stool using a preserving energy as a power source, comprising a suction power means provided with an injection nozzle for supplying additionally a portion of the cleaning water supplied into the water storage tank through a fine high speed injection way, a fluid operation tube for allowing the bad smell air to be absorbed forcibly through pressure difference therein caused from the injection input of the cleaning water, and a bad smell air discharging means for separating the fluid (cleaning water, bad smell air) which is inputted through the fluid operation tube, and guiding and discharging them, but prevention the bad smell air from being back flowed. According to the present invention, electric energy which is consumed by operating the conventional suction motor and impeller can be saved, and further environment of a bath room is to be comfortable by preventing noise which is produced with machine operations.

Another object of the present invention is to provide an odor removal toilet stool using a preserving energy as a power source, capable of saving pipe water such that through supplying procedures of the cleaning water at different steps of time by using the suction power means, in case of urine or vomiting, which needs relative shorter time period and rapid water pouring, a user may use the amount of the cleaning water stored until then and drain the excrement.

Another object of the present invention is to provide an odor removal toilet stool using a preserving energy as a power source, capable of: producing a disguise sound (etiquette bell) which is almost similar to natural sound without preparing separately an artificial disguising sound creating device driven by an external power, by a fine high speed injection with an injection nozzle when supplying the supplementary water, and by water drop sound falling down on water surface; and preventing shame felt when his/her physiological sound is transferred to other persons.

Technical Solution

To achieve the above objects, the odor removal toilet stool using a preserving energy as a power source according to the present invention, consisting of a stool body for containing feces and urine and discharging them to a water purifier tank, a water storage tank for storing a cleaning water used for discharging the excrement, which is provided on external part thereof with a water pouring button for draining the stored cleaning water, and a seat on which a user seats comfortably, comprises:

a suction power means for supplying additionally the cleaning water into the water storage tank during a predetermined time period in order to absorb forcibly bad smell air within the stool body without a separate external power using a water saving effect based on different excreting time periods of each user and a standby pressure differences based on hydrodynamic operations; a fluid operation tube for allowing air movement such as an external discharging after absorbing forcibly the bad smell air in a state of instant vacuum caused from pressure difference of internal space which is occurred during supplementing the cleaning water through the suction power means; and a bad smell air discharging means wherein the fluid flowed-in through the fluid operation tube is separated naturally based on its specific gravity, and the bad smell air of fine particles ascends as a rotation air current along the circular inner wall surface and then is discharged downward, and the fine water particles which is discharged together with the bad smell air forms a water film valve through water drops in order to prevent completely the finally discharged bad smell air from being back-flowed.

Advantageous Effects

As described above, according to the toilet stool using a preserving energy as a power source of the present invention, the bad smell air which is made at the same time when discharging the excrement outside the human body is absorbed through a pressure difference inside the fluid operation tube based on hydrodynamic operation when supplying additionally the cleaning water into the fluid operation tube through the fine high speed injection way using the suction power means, capable of absorbing forcibly the bad smell air and discharging it without using a separate electric energy and further omitting mechanical power means such as a suction motor and impeller susceptible to moisture. Furthermore, according to the present invention, it is possible to save a manufacturing cost, make simple maintenance and repair, improve product duration, and thus make a bathroom to be comfortable by diminishing mechanical driving sound.

Additionally, on a state before using the cleaning water such as the cleaning water is stored within the water storage tank up to the standby water level to an extent for a minimum siphon operation, in a case of urine or vomiting which requires shorter excreting time period during a supplying of the supplementary water which starts at the same time when using the toilet stool, a user may consume the cleaning water as amount as stored until then, which saves the remainder of the cleaning water from a full water level thereof without a separate water saving unit.

Meanwhile, according the present invention, a comfortable excreting is possible such that a physiological sound produced when excreting is not transferred to other person by being offset with a natural sound such as a water drop sound which is produced when the supplementary water supply (water supply) starts as soon as a user sits, without installing a separate etiquette bell. Additionally, a water pouring unit for expressing a disguise sound to offset the physiological sound does not necessary and as a result a water saving effect can be obtained.

BRIEF DESCRIPTION OF THE DRAWINGS

The following drawings, which are included to provide a further understanding of the invention and are incorporated in and constitute a part of this specification, illustrate embodiments of the invention and together with the description serve to explain the principle of the invention. In the drawings:

FIG. 1 is a perspective view illustrating a odor removal toilet stool according to a related art;

FIG. 2 is a view illustrating one embodiment of the odor removal toilet stool according to the related art;

FIGS. 3 and 4 are exploded perspective view and side-cross sectional view, respectively illustrating a constitutional relationship of the odor removal toilet stool using a preserving energy as a power source according to the present invention;

FIGS. 5 and 6 are front-sectional view and top-sectional view, respectively illustrating a inner configuration of a water storage tank mounted to the odor removal toilet stool using a preserving energy as a power source according to the present invention;

FIG. 7 is a perspective view illustrating an assembled state of a suction power means, a fluid operation tube, and a bad smell air discharge means in the odor removal toilet stool using a preserving energy as a power source according to the present invention;

FIG. 8 is a cross-sectional view illustrating an assembled state of an overflow tube and the fluid operation tube in the odor removal toilet stool using a preserving energy as a power source according to the present invention;

FIG. 9 is an exploded perspective view illustrating a configuration of a bad smell air discharge means in the odor removal toilet stool using a preserving energy as a power source according to the present invention;

FIG. 10 is a enlarged cross-sectional view illustrating an operation of the bad smell air discharge means in the odor removal toilet stool using a preserving energy as a power source according to the present invention;

FIG. 11 a perspective view illustrating an operation relation between the water pouring button and the push button in the odor removal toilet stool using a preserving energy as a power source according to the present invention;

FIGS. 12-14 are exemplary views illustrating an operation of the odor removal toilet stool using a preserving energy as a power source according to the present invention;

FIG. 15 is a view illustrating one embodiment of the odor removal toilet stool using a preserving energy as a power source according to the present invention, which is assembled completely and used;

FIG. 16 is view illustrating an operation relation of the water pouring button, the push button and the second balltap in the odor removal toilet stool using a preserving energy as a power source according to the present invention; and FIG. 17 is a comparison table of saving water effect base on the water supply amount in the odor removal toilet stool using a preserving energy as a power source according to the present invention.

MODE FOR THE INVENTION

Other objects and advantages of the present invention can be understood by the following description, and become apparent with reference to the embodiments of the present invention.

Here, among the accompanying drawings, FIGS. 3 and 4 are exploded perspective view and side-cross sectional view, respectively illustrating a constitutional relationship of the odor removal toilet stool using a preserving energy as a power source according to the present invention, FIGS. 5 and 6 are front-sectional view and top-sectional view, respectively illustrating a inner configuration of a water storage tank mounted to the odor removal toilet stool using a preserving energy as a power source according to the present invention, FIG. 7 is a perspective view illustrating an assembled state of a suction power means, a fluid operation tube, and a bad smell air discharge means in the odor removal toilet stool using a preserving energy as a power source according to the present invention, FIG. 8 is a cross-sectional view illustrating an assembled state of an overflow tube and the fluid operation tube in the odor removal toilet stool using a preserving energy as a power source according to the present invention, FIG. 9 is an exploded perspective view illustrating a configuration of a bad smell air discharge means in the odor removal toilet stool using a preserving energy as a power source according to the present invention, FIG. 10 is a enlarged cross-sectional view illustrating an operation of the bad smell air discharge means in the odor removal toilet stool using a preserving energy as a power source according to the present invention, FIG. 11 a perspective view illustrating an operation relation between the water pouring button and the push button in the odor removal toilet stool using a preserving energy as a power source according to the present invention, FIGS. 12-14 are exemplary views illustrating an operation of the odor removal toilet stool using a preserving energy as a power source according to the present invention, FIG. 15 is a view illustrating one embodiment of the odor removal toilet stool using a preserving energy as a power source according to the present invention, which is assembled completely and used, FIG. 16 is view illustrating an operation relation of the water pouring button, the push button and the second balltap in the odor removal toilet stool using a preserving energy as a power source according to the present invention, and FIG. 17 is a comparison table of saving water effect base on the water supply amount in the odor removal toilet stool using a preserving energy as a power source according to the present invention.

As shown in FIGS. 3 AND 4, the odor removal toilet stool using preserving energy as a power source according to the present invention, consisting of a stool body 1-1 adapted for receiving feces and urine excreted from inside body when excreting and discharging into a water purifier tank, and a water storage tank 1-2 adapted for storing the cleaning water used to discharge the excrement contained therein, which are formed as a one-piece, and a seat 103 provided over the stool body 1-1 on which a user may seat comfortably, comprises:

a suction power means 2 provided inside the storage tank for supplying additionally the cleaning water into the water storage tank 1-2 during a predetermined time period in order to absorb forcibly bad smell air within the stool body 1-1 without a separate external power using a water saving effect based on different excreting time periods of each user and a standby pressure differences based on hydrodynamic operations; a fluid operation tube 3 for allowing air movement such as an external discharging after absorbing forcibly the bad smell air in a state of instant vacuum caused from pressure difference (instant vacuum state) of internal space which is occurred during supplementing the cleaning water through the suction power means 2; and a bad smell air discharging means 4 through which the fluid flowed-in through the fluid operation tube 3 is separated naturally based on its specific gravity, and the bad smell air (gas) of fine particles rises as a rotation air current along the circular inner wall surface and then is discharged downward, and the fine water particles which is discharged together with the bad smell air forms a water film valve through water drops in order to prevent completely the finally discharged bad smell air from being back-flowed.

The stool body 1-1, as shown in FIG. 2B, is provided therein with a excrement space 1-1*a* for containing feces and urine (hereinafter, referred to as "excrement") when excreting, and comprises a supply tube 1-11 for draining the cleaning water stored within the water storage tank 1-2 into the excrement space 1-1*a* when pouring water after excrement, and a trap tube 1-12 for discharging finally the excrement contained in the excrement space 1-1*a*, together with the cleaning water to the water purifier tank, which are preferably formed as one-piece.

In addition, an external discharging tube 1-13 is further formed as one piece on one rear side end of the stool body 1-1, which is provided for allowing pollutant gas (hereinafter, referred to as "bad smell air") dropped by a bad smell air discharging means 4 which is described later, to be discharged through the trap tube 1-12 into the water purifier tank.

The water storage tank 1-2 includes a tank part 1-22 provided with the storage space 1-2*a* therein capable of storing proper amount of the cleaning water for discharging excrement into the water purifier tank, and a tank cover 1-22 capable of covering an upper opening of the tank part 1-21, wherein a water pouring button 1-211 for allowing the cleaning water within the storage space 1-2*a* to be drained into the excrement space 1-1*a* is further mounted preferably to one external side of the tank part 1-21.

Furthermore, the water storage tank 1-2 includes a first balltap 1-212 provided with: a first vertical tube 1-212*a* which is provided and connected to an internal bottom surface of the tank part 1-21 and adapted to supply the cleaning water to the storage space 1-2*a*, a second vertical tube 1-212*b* for supplying minimum fresh water enough for the excrement to be submerged within the excrement space 1-1*a*, a first floating unit 1-212*c* for control and set variably the storage amount of the cleaning water supplied from a water pipe, and a first water level regulator 1-212*d*; and a over flow tube 1-213 hinged-connected with a siphon cover 1-213*a*, which is opened with an operation of the water pouring button 1-211 and allows the cleaning water within the storage space 1-2*a* to be flowed through the supply tube 1-11 and the excrement space 1-1*a* and, together with the excrement contained therein, be passed through the trap tube 1-12, and finally be discharged into the water purifier tank.

Meanwhile, a opening and closing stick 1-211*a* is further hinged-assembled to the rear end of the water pouring button 1-211, which is reciprocated upward and downward at a predetermined range by a pushing operation thereto so that the siphon cover 1-213*a* of the over flow tube 1-213 is forcibly opened.

Here, a through hole 1-213*b* is formed protrudingly from the external side of the over flow tube 1-213, which allows the cleaning water supplied additionally through the second vertical tube 1-212*b* to be supplied into the excrement space 1-1*a* of the stool body 1-1, and an injection hose 1-214 for supplying small amount of fresh water is connected in communication between the second vertical tube 1-212*b* and the through hole 1-213*b*.

The seat 1-3 is comprised preferably of a stool seat 1-31 which is fixed to the upper front end of the stool body 1-1 with a separate connection member such as bolts, etc. (not shown) and adapted for a user to be seated conveniently thereon, and a stool seat cover 1-32 capable of covering the upper end of the stool seat 1-31.

The suction power means 2, as shown in FIGS. 5 and 7, is provided for supplying additionally the cleaning water (hereinafter, referred to as "supplementary water") at a predetermined time period into the water storage tank 1-2 when starting an excrement action, and for absorbing forcibly bad smell air using a hydrodynamic principle such as instant vacuum within the fluid operation tube 3 which is occurred through the supply of the supplementary water. Here, the suction power means 2 includes: a second balltap 21 for supplying additionally the supplementary water from the water pipe: a second water supply hose 22 for supplying the supplementary water supplied through the second balltap 21 into the fluid operation tube 3: a injection nozzle 23 one end of which is connected to the second water supply hose 22 and the other end of which is inserted through a cut and curve part in a spherical form of the fluid operation tube 3, and which is provided for injecting finely the supplementary water at a high speed and then inducing pressure difference such as a vacuum formation inside the fluid operation tube 3; a push button 24 which is mounted exposedly to one external side of the tank part 1-21 adjacently to the water pouring button 1-211 and adapted for intermitting the closing and opening of the second balltap 21 supplying additionally the supplementary water by its repeated pushing operation; an unlocking member 25 which is assembled to the rear end of the push button 24 and the lower side end of the opening and closing stick 1-211*a* of the water pouring button 1-211, and provided for closing a fill valve (not shown) of the second balltap 21 through an interacted operation with the opening and closing stick 1-211*a* that is rotated upward when pouring water after excreting at a shorter time period such as urine; and a pulling wire 26 one end of which is connected to the rear end of the push button 24 and the other end of which is connected to the second balltap 21, and which is capable of closing the fill valve by being pulled with the push button 24 that is released through an operation of the unlocking member 25.

In addition, the unlocking member 25 is comprised of: a wire 251 one end of which is connected to the lower end of one side of the opening and closing stick 1-211*a* of the water pouring button 1-211 and the other end of which is connected to one surface of the rear end of the push button 24, and which performs a pulling operation to release the pushing state of the push button; and a pulley 252 which is connected rotatably to one side of the body of the push button 24 and is provided for performing smoothly the pulling operation of the wire 251.

Meanwhile, a third vertical tube 211 for supplying additionally the supplementary water only into the second water supply hose 22, a second floating unit 212 and a second water level regulator 213 for controlling the amount of the supplementary water not to exceed to the proper storage amount, are provided on the second balltap 21. Therefore, the fill valve can be closed by connecting simply the pulling wire 26 to one side of the external end of the second floating unit 212.

The fluid operation tube 3, as shown in FIGS. 7 and 8, is provided for absorbing forcibly the bad smell air within the stool body 1-1 with an air transfer method which uses an internal pressure reduction phenomenon induced from a fine and high speed injection of the supplementary water through the injection nozzle 25, without a separate external power source. Here, the fluid operation tube 3 is shaped as "¬" character and its the lower end of a straight tube in a vertical direction is connected in communication to the opening of the upper end of the over flow tube 1-213, and a cut and curve part thereof is formed as a spherical shape having a relative greater volume than that of the straight tube so that sufficient gas can be supplied and flowed. Furthermore, a horizontal straight tube is slanted at a predetermined angle (θ) for a tip end thereof to be downward so that a speed discharging flow of water drops consisting of fine particles can be induced.

The bad smell air discharging means 4, as shown in FIGS. 7, 9 and 10, is provided for that the fluid injected through the fluid operation tube 3 is separated naturally into top and bottom parts based on specific gravities of the fine particles at the same time when being injected, and light gas rises in a form of rotation air current and then is discharged completely through an induction procedure of free fall, and when after completing the supply of the supplementary water, the bad smell air is prevented from being flowed back through a water film valve that is produced with water drops discharged together with the gas. Here, the bad smell air discharging means 4 is comprised of a induction drum 41 adapted such that the injected fluid rises as a rotation air current and at the same time water drops of larger particles (liquid) fall downward and then the cleaning water within the storage space 1-2*a* is supplemented for a predetermined time period, thereby separating naturally the fluid, and a barrel 42 adapted such that the bad smell air and the water drops of fine particles risen through the induction drum 41 are received therein and leaded to the trap tube 1-12, thereby preventing an external discharge of the bad smell air and a flow back thereof.

The induction drum 41 is configured as a cylinder such that the tip end of the fluid operation tube 3 is in communication with deflectively one external peripheral part of the induction drum, and the upper end thereof is covered to be rested over the upper end of the barrel 42, and the lower end thereof is opened. Additionally, the lower end of the induction drum 41 is not fully contacted with the bottom surface of the tank part 1-21 and a predetermined space is formed therebetween, and thus the cleaning water within the storage space 1-2*a* fills and inputs into the induction drum, while the water drops of greater particles among the fluid injected through the fluid operation tube 3 is used as a supplementary water to increase water level of the cleaning water.

The barrel 42 is comprised of a fall induction tube 421 for receiving and falling down the fluid risen by the induction drum 41, and a discharge induction tube 422 on upper end of which a back-flow prevention plate 422-1 is assembled. Here, the back-flow prevention plate creates the water film valve with water drops in order to discharge the fluid passing through the fall induction tube 421 and prevent injected bad smell air (gas) from being back-flowed.

Additionally, the fall induction tube 421 is comprised of: a funnel part 421*a* on the upper end thereof on which a plurality of passing holes 421*a*-1 for allowing the rising fluid in a form of a rotation air current to be passed is formed at each same distances, and which is configured in a form of a upper wide and lower narrow for receiving the passed water drops and guiding them efficiently into a center thereof; a induction part 421*b* on the middle end thereof which has a relative narrower diameter than that of the funnel part 421*a* for falling down efficiently the bad smell air and the water drops and is configured in a straight tube form, and a first enlarged part 421*c* on the remote end thereof a discharge sectional area of which is enlarged increasingly downward from the lower end of the induction part 421*b* in order to settle the unsmooth fluid discharge operation which is interrupted with the back-flow prevention plate 422-1.

Meanwhile, in an operation of the fall induction tube 421, when the supplementary water supplied additionally exceeds to a full water level, the overflowed cleaning water is flowed through the passing holes 421*a*-1 and the barrel 42, and passes the external discharge tube 1-13 and the trap tube 1-12, and is discharged into the water purifier tank. Accordingly, the fall induction tube can replaces the functions of a typical overflow tube.

Here, the discharge induction tube 422 is provided on the upper end with a second enlarged part 422*a* which has the same diameter as the lower part of the first enlarged part 421*c* to be connected thereto, and has relatively smaller diameter at the lower end thereof in order to be communicated to the external discharge tube 1-13.

Referring to the back flow prevention plate 422-1, it is provided through the second enlarged part 422*a* of the discharge induction tube 422 as one piece so that when the supply of the supplementary water by the suction power means 2 is ended, the water film valve is to be formed with the flowing down water drops which has been already made on the inner wall of the induction part 421*b* or the first enlarged part 421*c*, thereby preventing the bad smell air from being back-flowed. Furthermore, the back flow prevention plate 422-1 is comprised of: a plurality of track ends 422-11 and cut and curve ends 422-12 which is configured as a circular stepwise rising toward external side based from a center thereof so that the water drops can be distributed evenly overall areas at the instant moment of the gas flow being dropped; and a drilled hole tube 422-13 is formed as a straight tube of a predetermined diameter and length, and disposed downward from the respective surfaces of the track ends 422-11, and thus allows the fluid to be passed through but the fallen (or flowed) water drops to be stayed inside by their attraction operation during a movement along the track ends 422-11 and the cut and curve ends 422-12, thereby forming the water film valve.

Here, not-described reference numeral, 1-1*b* designates a through-flow hole a plurality of which are disposed on the edges of the excrement space to be communicated to the supply tube, and which is provided for draining the cleaning water that pushes the excrement to the trap tube through the supply tube in the stool body, or absorbing forcibly the bad smell air. In addition, the reference numeral, 1-21*a* designates a drainage hole for allowing the cleaning water within the storage space of the tank part to be inputted into the supply tube, and 1-21*b* designates a discharge hole for discharging the fluid that is flowing down through the barrel, through the external discharge tube.

The operations of the odor removal toilet stool using a preserving energy as a power source according to the present invention will be described in detail as follows.

Firstly, as shown in FIG. 12, an initial standby water level before using it is set such that the height of the first floating unit 1-212*c* for regulating the water level that is assembled on the upper side of the first water level regulator 1-212*d* of the first balltap 1-212 which is basically installed within the water storage tank 1-2, is lowered to the height of about ½ or ⅔ of the full water level within the storage space 1-2*a*. Subsequently, the cleaning water supply from the standby water level to a remainder of full water level is performed with the supplementary water which is additionally supplied at a predetermined time period by opening the fill valve of the second balltap 21 with an operation of the push button 24 by a user when excreting.

Here, the standby water level is set to the height possible of a minimum siphon operation and thus when rapid excrement such as urine or vomiting is performed, only the amount of the cleaning water at the standby water level is enough to discharge the excrement without the additionally supplied supplementary water through an operation of the push button 24, thereby obtaining a first saving water effect.

Meanwhile, when the supplementary water is not able to be supplied additionally due to mis-operations of the push button 24 or the second balltap 21, the first floating unit 1-212*c* is raised to the height of the full water level to solve simply the above problem.

Continuously, as shown in FIGS. 3 to 6, the suction power means 2, the fluid operation tube 3, and the bad smell air discharge means 4 are all assembled and installed within the water storage tank 1-2, thereby completing a configuration of the odor removal toilet stool A according to the present invention.

At this time, the second balltap 1-212 of the suction power means 2 may be connected to the water pipe installed on one wall surface of a bathroom by using a separate hose and thus makes the additional supply of the supplementary water possible. Additionally, a user seats on the stool seat 1-31 of the seat 1-3 and then pushes the push button 24 to open the second balltap 21 and thus the supplementary water is inputted through the third vertical tube 211 and the second water supply hose 22. Here, the cleaning water is fine-injected at a high speed into the fluid operation tube 3 with the injection nozzle 25 and then passes through the induction drum 41, and supplied additionally to within the storage space 1-2*a* at a predetermined time period, to raise the water level of the cleaning water so that the cleaning water is stored up to the full water level defined by the second floating unit 212 and the second water level regulator 213 of the second balltap 21, and thus the discharging process of the excrement into the water purifier tank when completing the excrement is performed without difficulties.

Hereinafter, all steps and procedures for creating disguising sound almost similar to a natural sound to offset an excrement sound, together with a removal of the bad smell air made when excreting and a prevention of its back flow, will be described, referring to the accompanying drawings.

Firstly, as shown in FIGS. 11, 12 and 15, a user seats on the stool seat 1-31 of the seat 1-3 assembled to the stool body 1-1 and at the same time he/she pushes the push button 24, as shown in FIG. 13, for supplying additionally the supplementary water for discharging efficiently the excrement, to loose the pulling wire 26, thereby making the second floating unit 212 and the second water level regulator 213 of the second balltap 21 leaned, causing the fill valve of the second balltap 21 to be opened.

As a result, the cleaning water stored up to the standby water level is raised by the supplementary water which is supplied through the third vertical tube 211 of the second balltap 21 and the second water supply hose 22, and further the disguising sound (etiquette bell) is produced by a water supply sound of the supplementary water which is fine-injected into the fluid operation tube 3 through the injection nozzle 25 at a high speed and a water supply pressure in order to offset a physiological sound produced when excreting. Accordingly, other persons do not notice his/her excrement behavior and further water saving effect from a prevention of water pouring is obtained.

Meanwhile, when the supplementary water is fine-injected at a high speed into the fluid operation tube 3 through the injection nozzle 25, the water particles with a relative lower density are rapidly injected into the induction drum 41 along the inner wall of the fluid operation tube 3 based on a Coanda effect. At this time, an instant vacuum state is produced within the fluid operation tube 3 and further the pressure is decreased by a rapid fluid movement (Bernoulli effect) and a strong absorption force is created by an interaction which accelerates the reduced pressure within the fluid operation tube 3, causing other gases to be transferred rapidly toward the induction drum 41.

Here, through this hydrodynamic phenomenon, the bad smell air which has been given out the excrement space 1-1*a* through the plurality of flow-through holes 1-1*b* and water drainage holes 1-21*a* is absorbed forcibly into the fluid operation tube 3 through the over flow tube 1-213, and this operation continues until when the supplementary water supply is ended by the suction power means 2 (about 5 minutes).

In this case, the duration of discharging the bad smell air corresponds to that of the supplementary water supply, and the time period of the additional supplementary water supply and the discharging time can be controlled based on the typical excrement time period.

Additionally, the fluid (including the bad smell air) moving along the fluid operation tube 3 is injected efficiently into the induction drum 41, and at this time since the cut and curve part of the fluid operation tube 3 is formed as a spherical form having a relative great volume for an efficient absorption, and further the tip end of the straight tube is formed as a deflective form having a slant angle (θ) not to intercept the gar flow, the water drops adhered to the inner wall surfaces of the fluid operation tube 3 is flowed smoothly into the induction drum 41.

After that, the flowed-in-fluid is separated upward and downward depending on their specific gravities, wherein the gas (bad smell air) having a lower specific gravity rises in a rotation air current form along the inner wall surface of the induction drum 41 and then passes through the plurality of the passing hole 421*a*-1 which are formed evenly overall upper surface of the funnel part 421*a* over the fall induction tube 421 of the barrel 42. Subsequently, the fluid descends rapidly along the induction part 421*b* and passes through the discharge induction tube 422 and then is discharged finally to the external discharge tube 1-13. Meanwhile, the water drops having a relative greater specific gravitation than that of the gas fall over a water surface of the cleaning water with their gravity interaction.

As a result, the descending bad smell air passes through the barrel 41 and is discharged to the water purifier tank through the external discharge tube 1-13, and the fine water particles discharged with the bad smell air is guided by the funnel part 421*a* and then may stay on the induction part 421*b* or the inner wall surface of the first enlarged part 421*c* as a form of small water drops, or a portion thereof falls down and then be discharged through the drilled holes 422-13 formed on the back flow prevention plate 422-1. Here, when the air flow is stopped due to the end of the additional supplementary water supply, the water drops staying on the inner wall surfaces of the induction part 421*b* conglomerates rapidly and at the same time they flow into a center of the back flow prevention plate 422-1, and further sink into the drilled hole tube 422-13 and form a water film valve with water attractive operation, thereby preventing completely the bad smell air discharged out from being back flowed.

Here, even when completing the excrement behavior during supplying the supplementary water to the full water level, as shown in FIG. 14, a user may push the water pouring button 1-211 to drain the cleaning water, and it causes the excrement contained in the excrement space 1-1*a* to be discharged to the water purifier tank. Meanwhile, as the opening and closing stick 1-211*a* of the water pouring button 1-211 is rotated upward, the wire 251 of the unlocking member 25 assembled connectively thereto draws backward the push button 24 and returns to its initial position before being pushed.

As a result, the pulling wire 26 connected to the rear end of the push button 24 is pulled, which pulls forcibly the second water level regulator 213 of the second balltap 21 and closes the fill valve of the second balltap 21, causing the stop of the supplementary water supply.

That is, as shown in FIG. 16, through an interaction of the water pouring button 1-211, the push button 24 and the second balltap 21, a second water saving effect can be obtained such that the water is poured on a state that the supplementary water is not filled to the full water level since the supplementary water is no more supplied additionally from the injection nozzle 25.

Meanwhile, water level changes of the cleaning water and the supplementary water are shown in detail, referring to FIG. 17.

Eventually, as shown in FIG. 17, the bad smell air is forcibly absorbed through the suction power means 2 using hydrodynamic principle operation without a separate electric energy, and further the fine water particles discharged together with the bad smell air may stay through their attractive operations within the plurality of drilled hole tube 422-13 formed on the back flow prevention plate 422-1 of the bad smell air discharge means 4 to form a water film valve, thereby preventing the bad smell air from being back-flowed. Additionally, the etiquette bell for offsetting physiological sound produced when excreting is produced by a water supply sound of the supplementary water which is fine-injected from the injection nozzle 25 at a high speed, and further efficient water saving effect is obtained through a water pouring when excreting urine before the cleaning water as additionally supplied supplementary water rises to the full water level from the standby water level of the cleaning water prior to using it.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

The invention claimed is:

1. An odor removal toilet stool using a preserving energy as a power source consisting of a stool body for containing feces and urine and discharging them to a water purifier tank, a water storage tank for storing a cleaning water used for discharging the excrement, which is provided on external part thereof with a water pouring button for draining the stored cleaning water, and a seat on which a user seats comfortably, comprising:

a suction powerer means provided within the water storage tank for supplying additionally the cleaning water into the water storage tank during a predetermined time period in order to absorb forcibly bad smelling air within the stool body without a separate external power using a water saving effect based on different excreting time periods of each user and a standby pressure differences based on hydrodynamic operations;

a fluid operation tube for allowing air movement such as an external discharging after absorbing forcibly the bad smelling air in a state of instant vacuum caused from pressure difference of internal space which occurs during supplementing the cleaning water through the suction powerer; and a bad smelling air discharger wherein the fluid flowed-in through the fluid operation tube is separated naturally based on its specific gravity, and the bad smelling air of fine particles rises as a rotation air current along the circular inner wall surface and then is discharged downward, and the fine water particles which is discharged together with the bad smelling air forms a water film valve with water drops in order to prevent completely the finally discharged bad smelling air from being back-flowed.

2. An odor removal toilet stool using a preserving energy as a power source according to claim 1, wherein the suction powerer comprises:

a second balltap for supplying additionally the supplementary water from a bathroom or a water pipe therein;

a second water supply hose for supplying the supplementary water supplied through the second balltap into the fluid operation tube;

an injection nozzle for injecting finely the supplementary water at a high speed and inducing a pressure difference such as a formation of instant vacuum in an internal space of the fluid operation tube, one end of which is connected to the second water supply hose and the other end of which is inserted through the cut and curve part of a spherical form of the fluid operation tube;

a push button for opening and closing intermittently the second balltap which supplies additionally the supplementary water by being pushed repeatedly, which is mounted exposedly to one external side of the low tank adjacently to the water pouring button;

an unlocking member which is assembled to the rear end of the push button and one side of the water pouring button, and is provided for closing the second balltap through an interacted operation with the water pouring button after excreting at a shorter time period such as urine; and a pulling wire one end of which is connected to the rear end of the push button and the other end of which is connected to the second balltap, and which is capable of closing the second balltap by being pulled with the push button which is released by an operation of the unlocking member.

3. An odor removal toilet stool using a preserving energy as a power source according to claim 1, wherein the fluid operation tube is formed as a cut and curve form of "¬" character, wherein the upper part thereof is formed as a spherical form having a relative greater volume than a cylindrical straight tube for supply sufficiently air and making efficient flow, and wherein a horizontal straight tube is slanted at a predetermined angle for a tip end thereof to be downward so that a speed discharging flow of water drops of fine particles can be induced.

4. An odor removal toilet stool using a preserving energy as a power source according to claim 1, wherein the bad smelling air discharger comprises a induction drum which is provided for that the injected fluid rises as a rotation air current and at the same time water drops of larger particles fall downward and then the cleaning water within the low tank is supplemented for a predetermined time period, and a barrel which is provided for receiving the bad smelling air and the water drops of fine particles risen through the induction drum, and guiding the bad smelling air to be discharged externally and preventing it from being back-flowed.

5. An odor removal toilet stool using a preserving energy as a power source according to claim 4, wherein the induction drum is configured as a lower opened cylinder wherein the tip end of the fluid operation tube is in communication with deflectively one external peripheral part thereof and the upper end thereof is covered to be rested over the upper end of the barrel, and the lower end thereof is not fully contacted with the bottom surface of the low tank and a predetermined space is formed therebetween, and thus the cleaning water fills and inputs into the induction drum, and further the water drops of greater particles among the fluid injected through the fluid operation tube are used as a supplementary water to increase a standby water level of the cleaning water.

6. An odor removal toilet stool using a preserving energy as a power source according to claim 4, wherein the barrel comprises a fall induction tube for receiving and falling down the fluid which is raised by the induction drum, and a discharge induction tube on upper end of which a back-flow prevention plate is assembled on the upper end, which creates the water film valve with water drops in order to discharge downward the fluid passing through the fall induction tube and prevent injected bad smelling air from being back-flowed.

7. An odor removal toilet stool using a preserving energy as a power source according to claim 6, wherein the fall induction tube comprises:

a funnel part on the upper end thereof on which a plurality of passing holes for allowing the rising fluid in a form of a rotation air current to be passed is formed at each same distances, and which is configured in a upper wide and lower narrow form for receiving the passed water drops and guiding efficiently them into a center thereof;

a induction part of a straight tube form on the middle end thereof which has a relative narrower diameter than that of the funnel part for falling down efficiently the bad smelling air and the water drops; and a first enlarged part on the remote end thereof a discharge sectional area of which is enlarged increasingly downward from the lower end of the induction part and kept in order to settle the unsmooth fluid discharging operation which is interrupted with the back-flow prevention plate creating a water film valve with water drops.

8. An odor removal toilet stool using a preserving energy as a power source according to claim 6, wherein the back flow prevention plate comprises a plurality of track ends and cut and curve ends which are configured as a circular stepwise rising toward external side based from a center thereof so that the water drops can be distributed evenly overall areas at the instant moment of the gas flow being dropped, and a plurality of drilled hole tube which is formed as a straight tube of a predetermined diameter and length and disposed downward from the respective surfaces of the track ends, and thus allows the fluid to be passed through but the fallen and flowed water drops to be stayed inside by their attraction operation during a movement along the track ends and the cut and curve ends to form the water film valve.

* * * * *